US010285516B2

(12) United States Patent
Bassouls et al.

(10) Patent No.: US 10,285,516 B2
(45) Date of Patent: May 14, 2019

(54) COMMUNICATING BOARD

(71) Applicant: Prismaflex International, Haute Rivoire (FR)

(72) Inventors: Pierre-Henry Bassouls, Lantignie (FR); Jean-Philippe Delmotte, Marcy l'Etoile (FR); Eric Bihr, Meys (FR)

(73) Assignee: Prismaflex International, Haute Rivoire (FR)

( * ) Notice: Subject to any disclaimer, the term of this patent is extended or adjusted under 35 U.S.C. 154(b) by 911 days.

(21) Appl. No.: 13/972,257

(22) Filed: Aug. 21, 2013

(65) Prior Publication Data

US 2013/0333259 A1 Dec. 19, 2013

Related U.S. Application Data

(63) Continuation of application No. PCT/FR2012/050249, filed on Feb. 6, 2012.

(30) Foreign Application Priority Data

Feb. 24, 2011 (FR) ..... 11 51502

(51) Int. Cl.
*G09F 1/12* (2006.01)
*A47G 1/06* (2006.01)
(Continued)

(52) U.S. Cl.
CPC ..... *A47G 1/06* (2013.01); *G09F 7/12* (2013.01); *G09F 15/0018* (2013.01); *G09F 15/0025* (2013.01); *G09F 15/02* (2013.01)

(58) Field of Classification Search
CPC ..... G09F 15/0025; G09F 17/00; G09F 13/04; G09F 15/0012
(Continued)

(56) References Cited

U.S. PATENT DOCUMENTS 4,107,826 A * 8/1978 Tysdal ..... 24/460
4,441,269 A * 4/1984 Dahl ..... 40/603
(Continued)

FOREIGN PATENT DOCUMENTS

BE 1014718 A6 3/2004
EP 1462024 A1 9/2004
(Continued)

OTHER PUBLICATIONS

International Search Report Application No. PCT/FR2012/050249 Completed: Apr. 19, 2012; dated Apr. 27, 2012 2 pages.

*Primary Examiner* — Shin H Kim
(74) *Attorney, Agent, or Firm* — Forge IP, PLLC

(57) ABSTRACT

A communicating board includes: a display medium including a sheet of fabric, the sheet of fabric comprising, on at least one surface, loops intended to cooperate with a gripping strip provided with hooks; at least one first gripping strip provided with hooks enabling to hold in position the display medium, and at least one substantially rectilinear profile including a first planar connecting surface having the at least one first gripping strip provided with hooks positioned thereon. The first planar connecting surface is inclined towards a rear surface of the display medium when the latter cooperates with the at least one first gripping strip provided with hooks, the first planar connecting surface forming with a visible planar surface of the display medium an angle greater than 30°.

14 Claims, 5 Drawing Sheets

(51) Int. Cl.

| | |
|---|---|
| ***G09F 7/12*** | (2006.01) |
| ***G09F 15/00*** | (2006.01) |
| ***G09F 15/02*** | (2006.01) |

(58) Field of Classification Search
USPC ..... 40/201, 763, 765, 790, 777
See application file for complete search history.

(56) References Cited

U.S. PATENT DOCUMENTS

| | | | | |
|---|---|---|---|---|
| 4,702,025 | A | 10/1987 | Mace | |
| 5,172,504 | A * | 12/1992 | De Maat et al. | 40/605 |
| 5,515,629 | A * | 5/1996 | Johansson | 40/745 |
| 6,339,889 | B1 * | 1/2002 | Griesemer et al. | 40/603 |
| 6,659,159 | B2 * | 12/2003 | Fritsche et al. | 160/371 |
| 7,069,682 | B2 * | 7/2006 | Gatt et al. | 40/793 |
| 7,225,569 | B2 * | 6/2007 | Pitt et al. | 40/603 |
| 8,015,736 | B2 * | 9/2011 | Frey | 40/549 |
| 2002/0170216 | A1 * | 11/2002 | Pearce | 40/597 |
| 2006/0090386 | A1 * | 5/2006 | Pitt et al. | 40/603 |
| 2006/0145047 | A1 | 7/2006 | Allekotte | |

FOREIGN PATENT DOCUMENTS

| | | | |
|---|---|---|---|
| FR | 2917879 | A1 | 12/2008 |
| FR | 2950724 | A1 | 4/2011 |

* cited by examiner

COMMUNICATING BOARD

FIELD OF THE INVENTION

The invention relates to the display of a message of information or advertising type on a display medium forming a poster. Such messages are generally displayed by means of communicating boards arranged outdoors or indoors.

The invention more specifically aims at communicating boards provided with a display medium made of a textile material, advantageously resilient, and comprising, on at least one surface, loops intended to cooperate with a gripping strip provided with hooks, with heads, or with points.

BACKGROUND OF THE INVENTION

As described in document FR 2 917 879, it is known to form display mediums formed by a sheet of fabric provided with loops on one of its surfaces to enable to attach it to a gripping strip.

Further, documents FR 2 950 724 and BE 1 014 718 both describe a communicating board comprising substantially rectilinear profiles. Each profile comprises a planar connecting surface receiving a gripping strip provided with hooks to hold in position a textile display medium having loops on its rear surface. In this case, the planar connecting surfaces are arranged parallel to the visible planar surface of the display medium.

However, this type of communicating board requires, for the operator who installs the display medium, a great skillfulness to accurately position the medium. Indeed, such a support is to have a very precise geometry in order to cooperate with the gripping strips arranged at the board periphery.

Further, this geometry should take into account a possible resilience of the medium, which is necessary to suppress wrinkles at the surface of the medium.

Thus, a first object of the invention is to ease the manufacturing and the installing of a textile display medium comprising loops on one of its surfaces, by allowing a positioning tolerance at the level of the selvedges cooperating with the gripping strip.

Further, the display medium attachment mode such as described in documents FR 2 950 724 and BE 1 014 718 has a limited mechanical resistance. The tearing resistance is thus not adapted to display mediums of large dimension, which may raise an issue, especially when the communicating board is placed in an outdoor environment and is submitted to mechanical stress such as generated by wind, rain, and cold.

Another object of the invention accordingly is to improve the mechanical resistance of the hook and loop attachment mode between a display medium and a profile having a planar connecting surface arranged thereon.

Further, and as described in documents U.S. Pat. No. 4,702,025 and US 2006/0145047, it is known to mask the selvedges of a display medium by means of a pivoting cache provided with resilient return means to lay the display medium flat against a planar portion of a rectilinear profile forming the board structure. The resilient return means thus enable to maintain the display medium in its position on the profile. In this case, the display medium should be substantially rigid and generally appears in the form of a paper sheet, which may also be plasticized to increase its rigidity. This implementation is thus generally limited to a format smaller than or equal to A1 paper and is only compatible with a rigid display medium or a display medium positioned between a back plate and a rigid transparent plate.

Thus, such a type of communicating board is not adapted when the display medium is made of a flexible material, and more specifically when it comprises a sheet of fabric. Indeed, this type of communicating board does not enable to stretch the display medium transversely and longitudinally, but only enables to lay it flat against a back surface.

Another aim of the invention thus is to achieve the holding in position of a flexible display medium on a communicating board provided with retractable caches at the level of the peripheral profiles delimiting the board, and this, in formats of several square meters, or even tens of square meters, and capable of withstanding climate-induced stress, among others, wind forces applied to the entire communication board.

SUMMARY OF THE INVENTION

The invention thus relates to a communicating board comprising

- a display medium comprising a sheet of fabric, this sheet of fabric comprising, on at least one surface, loops intended to cooperate with a gripping strip provided with hooks;
- at least one first gripping strip provided with hooks enabling to achieve the holding in position of the display medium;
- at least one substantially rectilinear profile comprising a first planar connecting surface having said at least one first gripping strip provided with hooks positioned thereon.

According to the invention, the communicating board is characterized in that the first planar connecting surface is inclined towards a rear surface of the display medium when the latter cooperates with said at least one first gripping strip provided with hooks, said first planar connecting surface forming with a visible planar surface of the display medium an angle greater than 30°.

In other words, such a communicating board enables to hold in position a flexible display medium by manually stretching the display medium and by positioning it on said first gripping strip. Such an installation under stress thus enables to suppress wrinkles at the surface of the display medium. Further, the hooks of the gripping strip may appear in various forms, and especially in the form of heads, of points, or any other forms capable of gripping the loops of the display medium with a resistance to tearing greater than $1\times10^{-3}$ N/mm$^2$.

Such a board may be formed of one or several profiles holding the display medium in position. Indeed, this type of communicating board may especially be used to generate a message hung or laid flat against an inner wall.

The fastening of the selvedges of the display medium to a gripping strip arranged on an inclined planar surface enables, above all, to improve the resistance and the hold of the display medium.

Further, such an inclined planar surface may be rotatably mobile with respect to the visible planar surface of the display medium. In this case, the angle greater than 30 degrees is obtained once the display medium is held in position and stretched to be exposed with no wrinkles at its surface.

Advantageously, the angle between the connecting surface and the visible planar surface of the display medium may be smaller than or equal to 180°.

A 180° angle indeed corresponds to a flap of the display medium at the rear surface of the substantially rectilinear profile, which may then be a thin elongated plate of constant thickness.

In practice, the first planar connecting surface may be formed by a lateral surface of a groove formed by the substantially rectilinear profile.

In this case, the selvedge of the display medium is positioned inside of the groove and is held in position by means of the first strip provided with hooks.

According to a specific embodiment, the communicating board may comprise at least one second gripping strip provided with hooks enabling to achieve the holding in position of said display medium, said substantially rectilinear profile comprising a second planar connecting surface having said second gripping strip provide with hooks positioned thereon, said second planar connecting surface being parallel to said visible planar surface of the display medium.

In other words, the display medium is held in positions both on a surface inclined with respect to the plane defined by its visible planar surface and on a surface parallel or even coplanar to the plane defined by its visible planar surface. Such an arrangement especially enables to ease the installing of the stretched display medium on the communicating board frame.

Advantageously, the communicating board may comprise a retractable cache capable of at least partially covering the display medium at the level of a selvedge.

The retractable cache enables to mask a possible jutting out of the sheet of fabric and a relative misalignment of the selvedge of the display medium with the rectilinear profile. Such an arrangement is particularly advantageous since it enables to do away with geometric dispersions especially due to the accuracy of the display medium manufacturing, and more specifically on printing of the advertising message or on cutting of the display medium, which then comes down to a simple and fast operation. Such a retractable cache indeed enables to mask the selvedge of the display medium and thus guarantees the rectilinear aspect at the visible periphery of the display medium.

Further, the retractable cache may also be formed in various ways and cooperate with the rectilinear profile according to various mechanical joints.

Thus, according to a first variation, the retractable cache may be arranged in a ball joint assembly with the substantially rectilinear profile, the ball joint being oriented around a longitudinal axis of the rectilinear profile and enabling the retractable cache to displace between, on the one hand, a closed position where it at least partially covers the display medium at the level of its selvedge and, on the order hand, an open position where it enables to install or to remove the display medium onto or from the first gripping strip provided with hooks.

Thereby, the retractable cache may pivot with respect to the substantially rectilinear profile and be flapped back on the selvedge of the display medium once installed on the first gripping strip. Such an arrangement is especially advantageous since the retractable cache remains constantly attached to the rectilinear profile while its installation on the display medium is very simple and fast to perform. Such a solution is thus adapted to frequent changes of display mediums.

According to a second variation, the retractable cache may comprise at least one protuberance intended to cooperate by snapping with a groove of complementary shape formed in the substantially rectilinear profile.

Thereby, once the display medium has been positioned on the first gripping strip, the selvedge of the medium is masked when the retractable cache is snapped into the groove of the substantially rectilinear profile.

According to a third variation, the retractable cache may comprise loop-type fastening means cooperating with complementary hook-type means placed on the substantially rectilinear profile.

Of course, it can also be envisaged to reverse the positioning of the loops and of the hooks between the two elements to be attached.

It may further be advantageous for long-time exposures of the display medium to decrease the cache to a minimum dimension. To achieve this, once the display medium has been positioned on the gripping strip(s) according to a usual method, that is, with excess display medium beyond the first gripping strip(s), it is possible to cut again the selvedges on the surface of a first gripping strip to then use this same first gripping strip as a support for a retractable cache provided with loops for cooperating with this first gripping strip. Such a solution has both the advantage of a narrower cache and of a minimized supply, while keeping a perfect finish.

In practice, the substantially rectilinear profile may cooperate with a rotating shaft enabling to stretch the display medium by rotation of the rotating shaft around an axis.

In other words, the connecting surface may be rotatably mobile around an axis in order to stretch the poster. Such a rotating shaft may further be arranged substantially horizontally or substantially vertically to enable a vertical or horizontal stretching of the display medium.

Further, according to the dimensions of the display medium, the communicating board may comprise mechanisms enabling to ease the installation of a large display medium. Such mechanisms then comprise substantially rectilinear profiles mobile with respect to the board frame. They thus enable to deploy the display medium in different directions, and especially in vertical and horizontal directions.

Thus, according to a first embodiment, the communicating board may comprise means for fastening and for stretching the display medium on a frame, said means comprising:

- a vertically shiftable, substantially rectilinear, horizontal profile capable of cooperating with an upper selvedge of the display medium;
- a substantially rectilinear horizontal profile capable of cooperating with a lower selvedge of the display medium;
- two groups, each comprising a plurality of independent modules, each module of a group being capable of vertically sliding with respect to a guide and of cooperating with a lateral selvedge of the display medium.

In other words, the plurality of independent modules enables to perform a stretching in the horizontal direction of the display medium without for all this preventing the stretching in the vertical direction of the display medium by means of the two horizontal profiles. Indeed, the use of independent modules capable of vertically sliding with respect to one another enables to give resilience to the joint of the lateral selvedges of the display medium with the frame of the communicating board. This resilience reflects as a resilient lengthening enabling to avoid the forming of wrinkled areas at the lateral selvedges of the display medium.

Further, the use of a plurality of independent modules also enables to ease the installation of the display medium from the bottom of the frame since it is only attached to the frame by a plurality of fastening areas separate from one another.

Such an arrangement also enables to limit friction as compared with a solution where the entire lateral selvedge of the display medium would be attached to the frame.

Advantageously, the horizontal profiles may comprise two other groups, each comprising a plurality of independent modules, each module of a group being capable of horizontally sliding with respect to a horizontal profile and of cooperating with a lower or upper selvedge of the display medium.

In other words, this arrangement also enables to limit the forming of wrinkles when the lateral selvedges of the display medium are pulled via the first two groups, each comprising a plurality of independent modules. Indeed, the two other groups enable to give the lower and upper horizontal selvedges of the display medium a resilience in the horizontal direction when a traction force in the horizontal direction is exerted on the display medium. Thus, as for the lateral selvedges, the use of independent fastening modules at the lower and upper selvedges enables to achieve a resilient elongation of the selvedges and avoids the forming of ripple.

According to a second embodiment, the communicating board may comprise means for fastening and for stretching the display medium on a frame, said means comprising:

- a horizontally shiftable substantially rectilinear vertical profile capable of cooperating with a first lateral selvedge of the display medium;
- a substantially rectilinear vertical profile capable of cooperating with a second lateral selvedge of the display medium;
- two groups, each comprising a plurality of independent modules, each module of a group being capable of horizontally sliding with respect to a guide and of cooperating with a horizontal selvedge of the display medium.

Thus, the plurality of independent modules enables to perform a stretching in the vertical direction of the display medium without for all this preventing the stretching in the horizontal direction of the display medium by means of the two vertical profiles. Indeed, the use of the independent modules capable of horizontally sliding with respect to one another provides resilience to the joint of the horizontal selvedges of the display medium with the frame of the communicating board. This resilience reflects as a resilient lengthening, enabling to avoid the forming of rippled areas at the horizontal selvedges of the display medium.

According to a specific embodiment, each module may comprise a third planar connecting surface having a third gripping strip provided with hooks positioned thereon.

In this case, the installing of the display medium on the modules is very fast. Simply placing into contact the rear surface of the display medium with the third gripping strips provided with hooks enables to perform this fastening and the subsequent holding in position.

Further, the third planar connecting surface may be inclined towards a rear surface of the display medium when the latter cooperates with a third gripping strip provided with hooks, this third planar connecting surface forming with a visible planar surface of the display medium an angle greater than 30°.

As previously, such as arrangement guarantees an optimal force of attachment of the lateral selvedges of the display medium to the sliding modules.

In practice, each module may comprise at least one fourth gripping strip provided with hooks enabling to hold in position said display medium, such a module comprising a fourth planar connecting surface having the fourth gripping strip provided with hooks positioned thereon, this fourth planar connecting surface being parallel to said visible planar surface of the display medium.

In other words, the display medium is held in positions at the level of each module both on a surface inclined with respect to the plane defined by its visible planar surface and on a surface parallel or even coplanar to the plane defined by its visible planar surface. Such an arrangement especially enables to ease the installing of the stretched display medium on the communicating board frame.

Advantageously, the communicating board may comprise at least one fifth gripping strip provided with hooks enabling to achieve the holding in position of a central area of said rear surface of the display medium.

The fifth gripping strip may be positioned on a wall having the communicating board arranged in front of it. However, the communicating board may also comprise a back plate intended to cooperate in planar joint with the display medium, where the back plate can then be equipped with the fifth gripping strip cooperating with the loops arranged at the rear surface of the display medium. Such a back plate may especially be made of a metallic, plastic, or wooden material. It may also be directly formed by a wall or an inner partition.

Of course, the communicating board may comprise a group of several fifth gripping strips. The fifth gripping strips may then be arranged in parallel fashion by being regularly spaced apart from one another.

BRIEF DESCRIPTION OF THE DRAWINGS

The way to implement the present invention, and the resulting advantages, will better appear from the description of the following non-limiting embodiment, given as an indication, based on the accompanying drawings, among which.

DETAILED DESCRIPTION OF THE INVENTION

As already mentioned, the invention relates to a communicating board comprising a display medium formed by a sheet of fabric and cooperating with at least one gripping strip provided with hooks.

Figure 1:
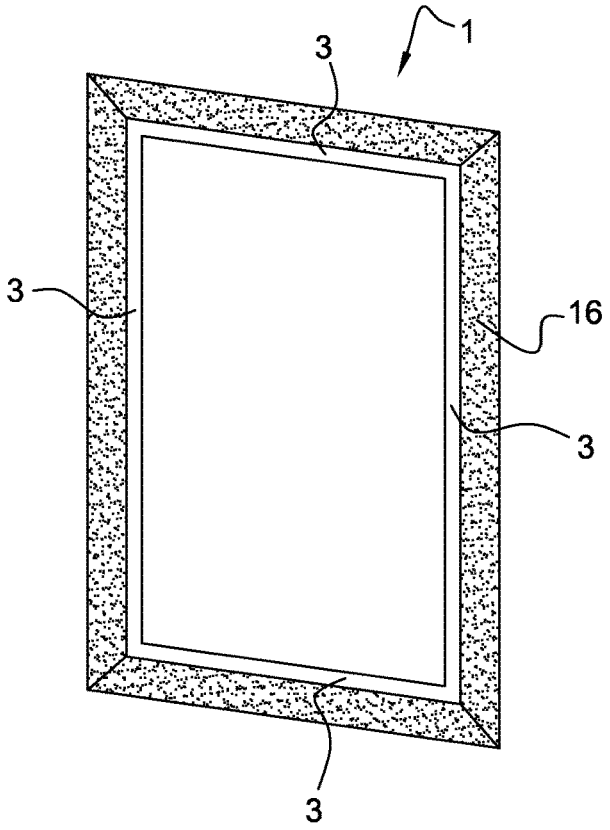
FIG. 1 is a perspective view according to a first variation of a communicating board according to the invention, without its display medium.

As shown in FIG. 1, communicating board 1 thus has four substantially rectilinear profiles 3 having first gripping strips 16 enabling to hold in position the selvedges of a display medium.

Figure 2:
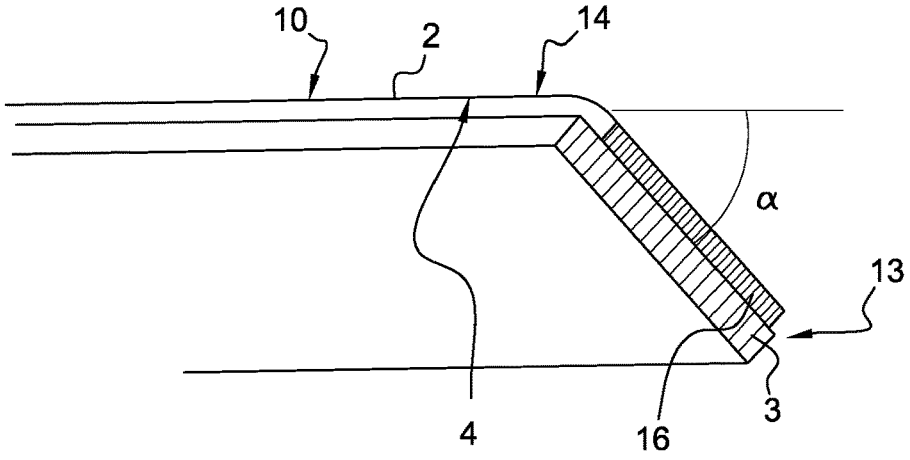
FIGS. 2 to 6 show partial cross-section views according to different variations of the selvedge of a display medium and of a rectilinear profile whereon it is placed.

As shown in FIG. 2, the communicating board is formed by the assembly of four substantially rectilinear profiles 3 comprising first planar connecting surfaces 13 inclined towards a rear surface 4 of display medium 2. An angle $\alpha$ thus defines this inclination with respect to visible planar surface 10 of display medium 2. Such an angle $\alpha$ is greater than 30° for an optimal holding in position of display medium 2 on substantially rectilinear profiles 3.

Indeed, such a display medium 2 comprises a sheet of fabric 14 and may have a resilience enabling to stretch it, to suppress possible wrinkles at its surface. Such a stretching then creates a shearing effort on the hook and loop connections, thus fastening the display medium to the frame of the communicating board.

Figure 3:
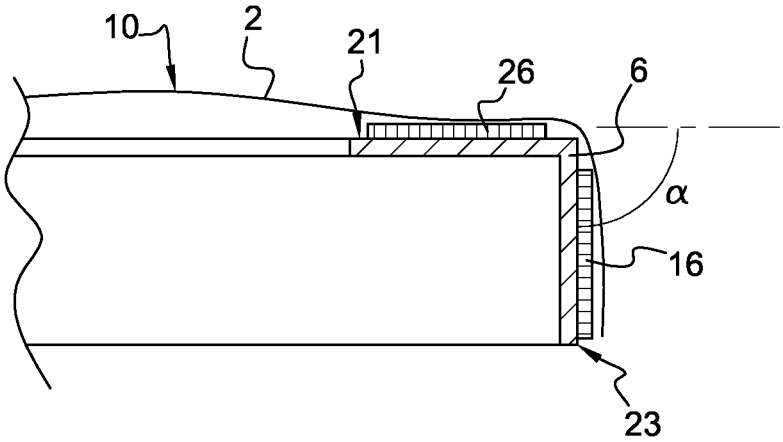

Further, and as shown in FIG. 3, substantially rectilinear profile 6 may also comprise a second gripping strip 26 arranged at the level of a second planar connecting surface 21. In this case, first planar connecting surface 23 is inclined by an angle α having a value of approximately 90° with respect to visible planar surface 10 of display medium 2.

Second planar connecting surface 21 is arranged parallel to visible planar surface 10 of display medium 2.

Figure 4:
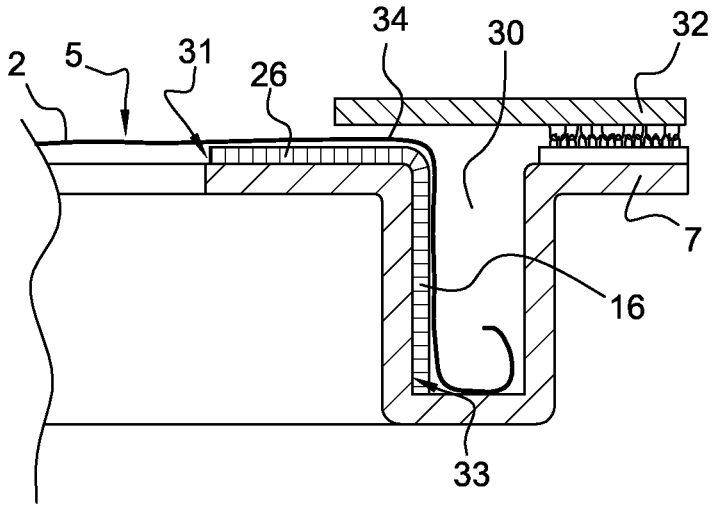

As shown in FIG. 4, substantially rectilinear profile 7 may form a groove 30 having display medium 2 inserted therein. In this case, the first planar connecting surface is formed by a lateral internal surface 33 of groove 30.

In the same way as in FIG. 3, such a profile 7 may comprise a second planar connecting surface 31 whereon a second gripping strip 26 may be placed.

As shown, first and second gripping strips 16, 26 are formed in a same strip simply folded to cooperate with first and second planar connecting surfaces 33, 31.

As shown, the communicating board may also comprise a retractable cache 32 capable of at least partially covering display medium 2 at the level of a selvedge 34.

As shown, retractable cache 32 may be installed by reversible hook-and-loop type fastening, but the invention is not limited to this single embodiment. It is indeed possible to use a retractable cache which is capable of pivoting or sliding with respect to rectilinear profile 7.

Figure 5:
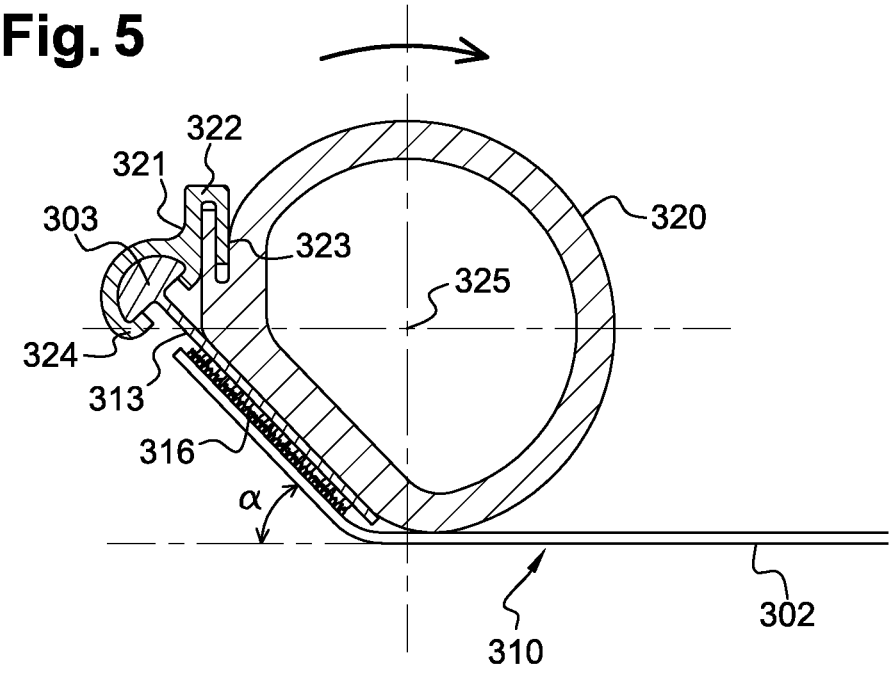

As shown in FIG. 5, the communicating board may also comprise a substantially rectilinear profile 303 comprising a planar connecting surface 313 inclined towards a rear surface 304 of display medium 302. An angle α then defines the inclination of planar connecting surface 313 equipped with a gripping strip 316 with respect to the visible planar surface 310 of display medium 302.

Such a profile 303 may especially appear in the form of a flexible profile comprising at the level of one of its selvedges a ring cooperating with a part 322. The ring is thus inserted into a groove formed by tabs 324 of part 322. Further, such a part 322 comprise a wing 323 intended to be introduced into a slot 321 formed in a rotating shaft 320.

The rotation of rotating shaft 320 around axis 325 then enables to stretch display medium 302. Such a stretching may indeed be useful on first installation of the display medium on the communicating board, and also after a usage period, when wrinkles appears at the surface of display medium 302.

Figure 6:
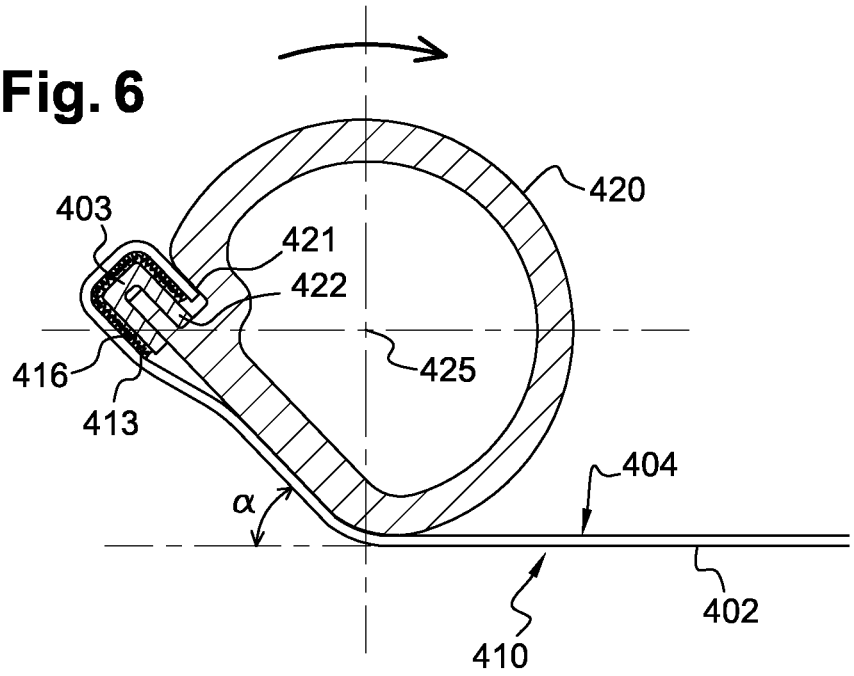

As shown in FIG. 6, and according to a variation, substantially rectilinear profile 403 may appear in the form of a U comprising a planar connecting surface 413 inclined towards a rear surface 404 of display medium 402. Planar connecting surface 413 is inclined by an angle α with respect to visible planar surface 410 of display medium 402 and is fitted with a gripping strip 416 to hold in position a selvedge of display medium 402.

Further, profile 403 comprises a wing 422 which is introduced into a groove 421 formed at the level of the internal surface of a rotating shaft 420. As previously, such a rotating shaft 420 enables to perform the stretching at the first installation of display medium 402 on the communicating board, but also after a usage period, when wrinkles appears at the surface of display medium 402.

Figure 7:
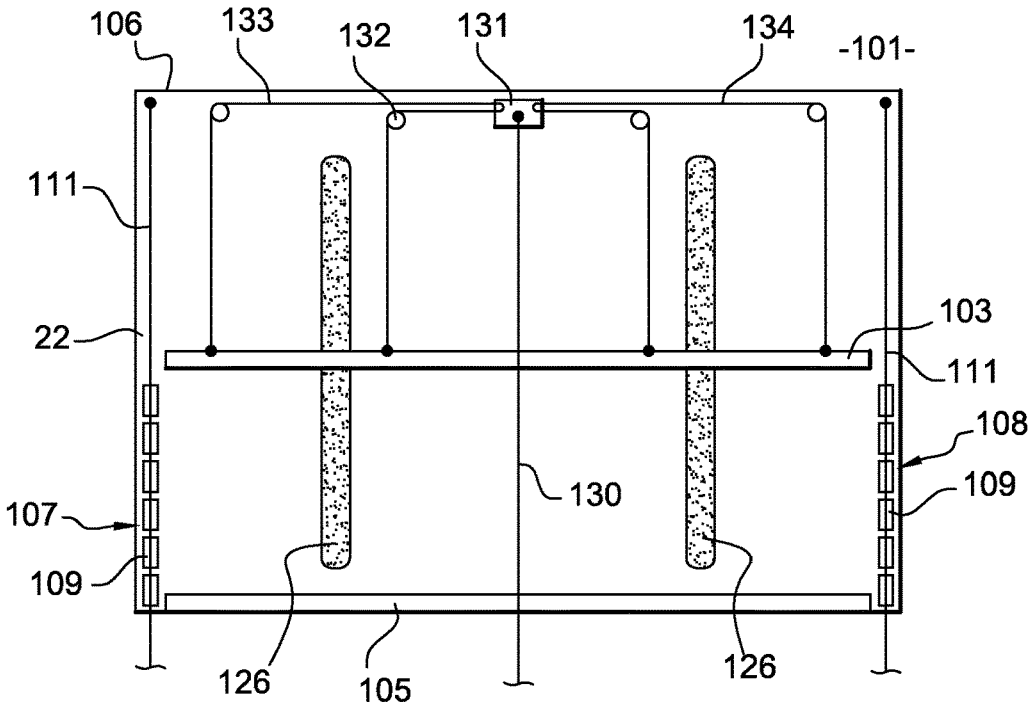
FIGS. 7 and 8 are front views of two other variations of a communicating board according to the invention where the display medium is deployed by mechanisms.

As shown in FIG. 7, communicating board 101 may comprise a frame 106 having mobile elements such as a vertically-shiftable substantially rectilinear horizontal profile 103 cooperating therewith, and capable of cooperating with an upper selvedge of the display medium. Such a communicating board 101 also comprises a substantially rectilinear horizontal profile 105 capable of cooperating with a lower selvedge of the display medium.

Further, two groups 107, 108, each comprising a plurality of modules 109 vertically sliding with respect to a guide 111 capable of cooperating with a lateral selvedge of the display medium.

Mobile profile 103 may be displaced by means of a manual actuation member, for example comprising a string 130 connected with a central part 131. Central part 131 is connected to two strings 133, 134 having their two ends attached to horizontal profile 103. Further, two sets of pulleys 132 enable to perform an angle transmission 131 with respect to profile 103 when an operator actuates rope 130.

As shown, communicating board 101 may also be equipped with a fifth gripping strip 126 provided with hooks enabling to achieve the holding in position of a central area of the rear surface of display medium 102.

Figure 9:
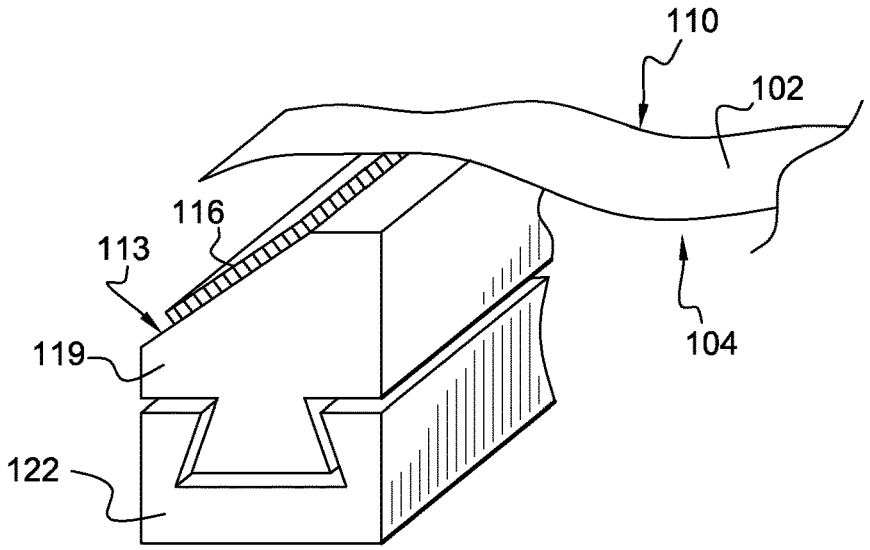
FIGS. 9 and 10 are perspective views showing the mode of attachment of the horizontal and/or vertical selvedges of a display medium on communicating boards such as those of FIGS. 7 and 8.

Further, as shown in FIG. 9, each module 119 may appear in the form of a block cooperating in a sliding joint according to a dovetail-type joint penetrating into a housing of complementary shape formed in a rail 122. Such an arrangement thus allows shifting motions between each independent module 119 and rail 122.

A third gripping strip 116 provided with hooks is here positioned on an inclined plane forming a third planar connecting surface 113. Third planar connecting surface 113 is indeed inclined towards a rear surface 104 of the display medium when the latter cooperates with third gripping strip 116 and the angle with respect to visible planar surface 110 of the display medium is greater than 30° to provide an optimal resistance to tearing.

Figure 8:
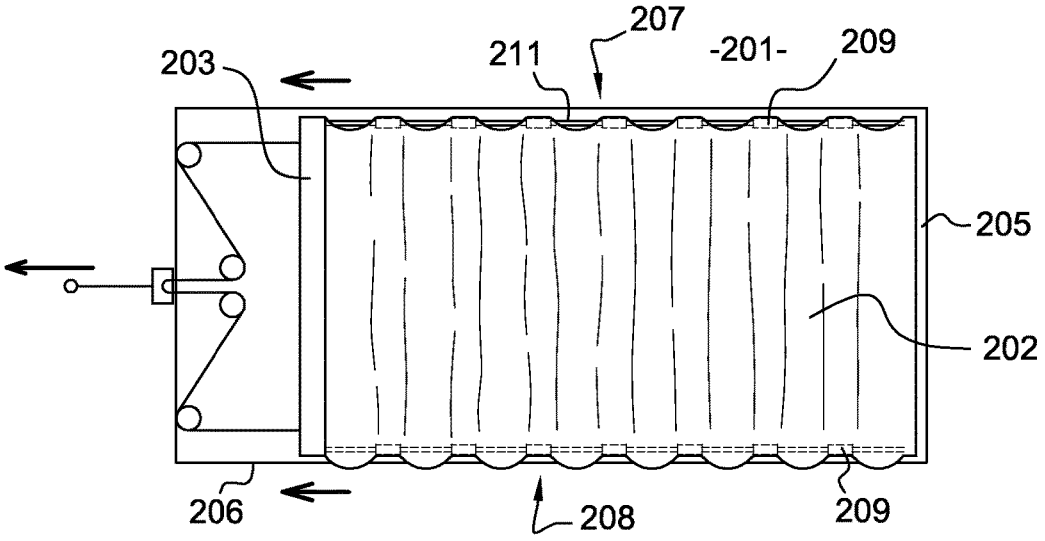

As shown in FIG. 8, communicating board 201 may comprise a frame 206 having mobile elements such as a horizontally-shiftable substantially rectilinear vertical profile 203 cooperating therewith, and capable of cooperating with a first lateral selvedge of display medium 202. Such a communicating board 201 also comprises a substantially rectilinear vertical profile 205 capable of cooperating with a second lateral selvedge of display medium 202.

Further, two groups 207, 208, each comprising a plurality of modules 209 horizontally sliding with respect to a guide 211 capable of cooperating with a horizontal selvedge of display medium 202.

As in FIG. 7, mobile profile 203 may be displaced by means of a manual actuation member, for example comprising a rope, pulleys, and a central part. The displacement of profile 203 thus enables to deploy display medium 202 and advantageously to perform the horizontal stretching.

Figure 10:
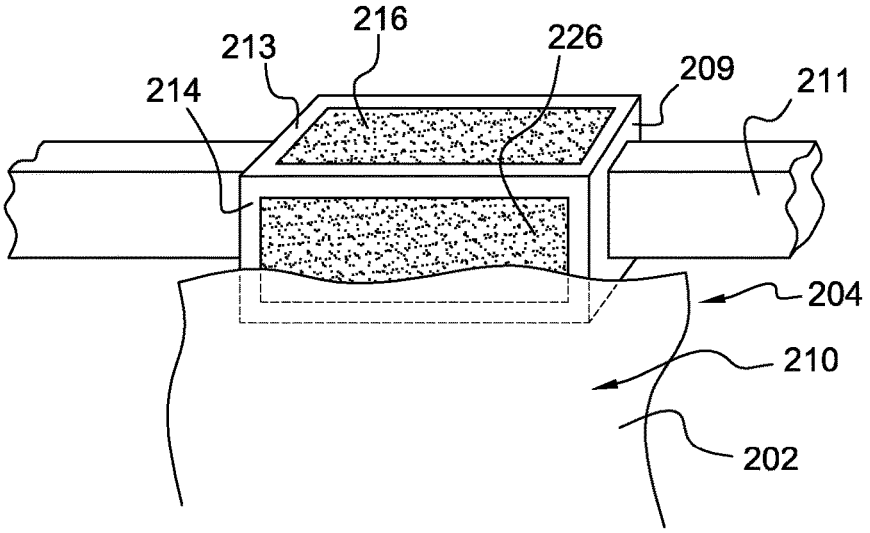

As shown in FIG. 10, each module 209 may appear in the form of a block cooperating in a sliding joint by means of complementary prismatic shapes between a guide 211 and a through opening formed in module 209. A third gripping strip 216 provided with hooks is here positioned on a surface inclined by 90° with respect to the plane of visible planar surface 210 of display medium 202.

This surface inclined by 90° thus forms a third planar connecting surface 213 inclined towards a rear surface 204 of display medium 202 when the latter cooperates with third gripping strip 216.

Further, module 209 also comprises a fourth planar connecting surface 214 having a fourth gripping strip 226 arranged thereon. Accordingly, the selvedge of display medium 202 is also attached to module 209 at the level of a gripping strip 226 arranged parallel to the plane defined by visible surface 210 of display medium 202.

Such an arrangement indeed eases the stretching of display medium 202 on fourth gripping strips 226, after which the flaps on third gripping strip 216 ensure the holding in position while avoiding any incidental tearing of display medium 202 by peeling at the level of modules 209.

As appears from the foregoing, a communicating board according to the invention has many advantages, and especially:

- it enables to hold in position a sheet of fabric forming a display medium;
- it enables to form surfaces of several square meters, or even tens of square meters, and especially capable of resisting wind stress;
- it enables to manually stretch the display medium on the profiles;
- it enables to do away with accuracy constraints for the display medium cutting and printing;
- it enables to significantly decrease costs by seriously limiting the board components used to install the communication support.

What is claimed is:

1. A communicating board comprising:

a display medium being totally formed by a sheet of fabric, said sheet of fabric comprising, on at least one surface, loops adapted to cooperate with a gripping strip provided with hooks, said loops being integral parts of the sheet of fabric;

at least one first gripping strip provided with hooks enabling to hold in position said display medium;

at least one substantially rectilinear profile, comprising a first planar connecting surface having said at least one first gripping strip provided with hooks positioned thereon;

characterized in that said first planar connecting surface is inclined towards a rear surface of the display medium when the latter cooperates with said at least one first gripping strip provided with hooks, said first planar connecting surface forming with a visible planar surface of the display medium an angle $\alpha$ greater than 30°.

2. The communicating board of claim 1, characterized in that the angle $\alpha$ between said planar connecting surface and the visible planar surface of the display medium is smaller than or equal to 180°.

3. The communicating board of claim 1, characterized in that said first planar connecting surface is formed by a lateral surface of a groove formed by said at least one substantially rectilinear profile.

4. The communicating board of claim 1, characterized in that said communicating board further comprises at least one second gripping strip provided with hooks enabling to achieve the holding in position of said display medium, said substantially rectilinear profile comprising a second planar connecting surface having said second gripping strip provided with hooks positioned thereon, said second planar connecting surface being parallel to said visible planar surface of the display medium.

5. The communicating board of claim 1, characterized in that said communicating board further comprises a retractable cache capable of at least partially covering the display medium at a level of a selvedge.

6. The communicating board of claim 1, characterized in that said at least one substantially rectilinear profile cooperates with a rotating shaft enabling to stretch the display medium by rotation of said rotating shaft around an axis.

7. The communicating board of claim 1, characterized in that said communicating board further comprises means for fastening and for stretching the display medium on a frame, said means comprising:

a vertically-shiftable substantially rectilinear horizontal profile capable of cooperating with an upper selvedge of the display medium;

a substantially rectilinear horizontal profile capable of cooperating with a lower selvedge of the display medium;

two groups, each comprising a plurality of independent modules, each module of a group being capable of vertically sliding with respect to a guide and of cooperating with a lateral selvedge of the display medium.

8. The communicating board of claim 1, characterized in that said communicating boar further comprises means for fastening and for stretching the display medium on a frame, said means comprising:

a horizontally-shiftable substantially rectilinear vertical profile capable of cooperating with a first lateral selvedge of the display medium;

a substantially rectilinear vertical profile capable of cooperating with a second lateral selvedge of the display medium;

two groups, each comprising a plurality of independent modules, each module of a group being capable of horizontally sliding with respect to a guide and of cooperating with a horizontal selvedge of the display medium.

9. The communicating board of claim 7, characterized in that each module comprises a third planar connecting surface having a third gripping strip provided with hooks positioned thereon.

10. The communicating board of claim 9, characterized in that said third planar connecting surface is inclined towards a rear surface of the display medium when the latter cooperates with said at least one third gripping strip provided with hooks, said third planar connecting surface forming with a visible planar surface of the display medium an angle greater than 30°.

11. The communicating board of claim 10, characterized in that each module comprises at least one fourth gripping strip provided with hooks enabling to achieve the holding in position of said display medium, said module comprising a fourth planar connecting surface having said fourth gripping strip provided with hooks positioned thereon, said second planar connecting surface being parallel to said visible planar surface of the display medium.

12. The communicating board of claim 1, characterized in that said communicating board further comprises at least one fifth gripping strip provided with hooks enabling to achieve the holding in position of a central area of said rear surface of the display medium.

13. A communicating board comprising:

a display medium comprising a sheet of fabric, said sheet of fabric comprising, on at least one surface, loops adapted to cooperate with a gripping strip provided with hooks;

at least one first gripping strip provided with hooks enabling to hold in position said display medium;

at least one substantially rectilinear profile, comprising a first planar connecting surface having said at least one first gripping strip provided with hooks positioned thereon;

characterized in that said first planar connecting surface is inclined towards a rear surface of the display medium when the latter cooperates with said at least one first gripping strip provided with hooks, said first planar connecting surface forming with a visible planar surface of the display medium an angle $\alpha$ greater than 30°; and in that said first planar connecting surface is formed by a lateral surface of a groove formed by said at least one substantially rectilinear profile.

14. The communicating board of claim 1, characterized in that the angle $\alpha$ between said planar connecting surface and the visible planar surface of the display medium is smaller than 90°.

* * * * *